United States Patent [19]

Stocker

[11] Patent Number: 4,779,480

[45] Date of Patent: Oct. 25, 1988

[54] MULTI RATIO ACCELERATOR CABLE MECHANISM

[75] Inventor: Raymond Stocker, West Bloomfield, Mich.

[73] Assignee: Ford Motor Company, Dearborn, Mich.

[21] Appl. No.: 120,245

[22] Filed: Nov. 3, 1987

Related U.S. Application Data

[63] Continuation of Ser. No. 881,537, Jul. 2, 1986, abandoned.

[51] Int. Cl.[4] ..... F16C 1/10; G05G 1/14; G05G 7/04

[52] U.S. Cl. ..... 74/513; 74/516; 74/500.5; 261/65; 251/229; 251/251

[58] Field of Search ..... 74/513, 516, 518, 501 R, 74/560, 512; 251/229, 233, 243, 251; 261/65

[56] References Cited

U.S. PATENT DOCUMENTS

| | | | |
|---|---|---|---|
| 1,916,323 | 7/1933 | Ludwig | 74/516 |
| 1,926,634 | 9/1933 | See et al. | 74/516 |
| 1,928,083 | 9/1933 | Warren | 74/516 |
| 1,991,663 | 2/1935 | Delaney | 251/233 X |
| 2,436,897 | 3/1948 | Nutt | 74/516 |
| 2,649,815 | 8/1953 | Kaye | 251/233 X |
| 2,672,156 | 3/1954 | Lecarmure | 74/516 X |
| 2,814,957 | 12/1957 | Mitrovich | 74/471 R |
| 3,086,406 | 4/1963 | Voser | 74/518 |
| 3,446,091 | 5/1969 | Stocker | 74/513 |
| 3,490,294 | 1/1970 | Antrim | 74/516 |
| 3,646,829 | 3/1972 | Reno | 74/513 |
| 4,352,483 | 10/1982 | Iacoponi | 74/513 X |
| 4,411,845 | 10/1983 | Tanghashi et al. | 261/65 |
| 4,428,891 | 1/1984 | Ishida et al. | 74/516 X |
| 4,429,589 | 2/1984 | Stocker | 74/513 |
| 4,476,068 | 10/1984 | Griffin et al. | 261/65 |

FOREIGN PATENT DOCUMENTS

| | | | |
|---|---|---|---|
| 375583 | 5/1923 | Fed. Rep. of Germany | 74/513 |
| 907973 | 4/1954 | Fed. Rep. of Germany | 74/512 |
| 936971 | 1/1956 | Fed. Rep. of Germany | 74/516 |
| 2416110 | 3/1974 | Fed. Rep. of Germany | 74/516 |
| 1224633 | 6/1960 | France | 74/513 |
| 485485 | 10/1953 | Italy | 74/516 |
| 718057 | 11/1954 | United Kingdom | 251/233 |
| 1359556 | 7/1974 | United Kingdom | 74/516 |

*Primary Examiner*—Gary L. Smith
*Assistant Examiner*—Rodney M. Lindsey
*Attorney, Agent, or Firm*—Robert E. McCollum; Clifford L. Sadler

[57] ABSTRACT

A cam and cam follower mechanism for connecting a vehicle accelerator pedal to the throttle body throttle valve for varying rates of movement of the throttle valve, including a washer-like cam operatively connected to the vehicle accelerator pedal and having an internal cam surface adopted to be engaged by a number of pins fixed to a throttle lever at different radial distances from the lever and throttle valve pivot, the pins each constituting fulcrums about which the throttle lever and throttle valve are forced to pivot one at a time as the accelerator pedal is moved angularly between closed and open throttle valve positions, the pins shifting as fulcrums upon continued movement of the accelerator pedal to provide initially a slow rate of opening of the throttle valve in response to a large angular movement of the accelerator pedal followed by a faster rate of movement of the throttle valve more nearly in proportion to the angular movement of the accelerator pedal.

3 Claims, 3 Drawing Sheets

10
12
14
16
17
18
19
20
22
24
26
30
32
34
36
42
43
44
46
48
50
52
53
54
56
58
60
62
64
66
70

MULTI RATIO ACCELERATOR CABLE MECHANISM

This application is a continuation of application Ser. No. 881,537, filed July 2, 1986 now abandoned.

This invention relates in general to a cable mechanism for connecting a vehicle accelerator pedal to an engine throttle body throttle valve linkage. More particularly, it relates to one that provides for a slow initial rate of movement of the throttle valve in response to depressing the accelerator pedal through a large angle followed by a faster rate of movement of the throttle valve in response to continued depression of the accelerator pedal through its final movement. This reduces coast-to-drive driveline backlash, pedal tip-in noise or feel, while at the same time providing a more precise low speed pedal control. The multi-rate control of the invention also provides a better feel and control by the operator with respect to the opening of the carburetor throttle valve, and one without the so-called driveline clunk that can result from changes in direction of application of torque when the drivetrain shifts from a coast to a drive condition.

The use of multi-rate movement control mechanisms in general to provide different rates of movement of a particular member is known. For example, my U.S. Pat. No. 3,446,091, shows and describes a cam and cam follower mechanism that provides different rates of movement of the accelerator pedal to maintain comfortable and positive operation. My patent, U.S. Pat. No. 4,429,589, further shows a dual ratio accelerator arm assembly providing dual fulcrums for various rate movements of the arm to control the opening movement of the carburetor throttle valve.

Other U.S. patents of interest illustrating other dual movement mechanisms are those to Griffin et al, No. 4,476,068; Iacoponi, No. 4,352,483; and Tanahashi et al, No. 4,411,845; all of which indicate cam and cam follower means for providing different rate movements of elements associated with a carburetor throttle valve.

Still further prior art of interest are the mechanisms shown and described by Mitrovich, U.S. Pat. No. 2,814,957; See et al, No. 1,926,634; Voser, No. 3,086,406; Ludwig, No. 1,916,323; and Warren, 1,926,083.

While the above references show in general devices providing dual rate movements, none show a simple and cost efficient multi-fulcrum cable control mechanism such as will be described. More particularly, the mechanism consists of a simple cam and cam follower device having a number of pivot points that alternate as fulcrums depending upon the position of the accelerator pedal to cause a slow initial opening movement of the throttle body throttle valve as the accelerator pedal is depressed through a large angle effecting a large linear travel of the cable, followed by a faster rate of opening movement of the throttle valve as the accelerator pedal is depressed through its final opening angle with a lesser linear travel of the cable mechanism, this being accomplished by an automatic switching from a lever arm of one length to another of a shorter length as the fulcrums change, and in a smooth efficient manner upon continued depression of the vehicle accelerator pedal moving the throttle lever and throttle valve from a closed to a wide open throttle position.

It is, therefore, a primary object of the invention to provide a multi-rate movement accelerator cable mechanism that consists of essentially few parts, is easy to assemble and disassemble, and yet provides a slow, initial rate of movement of the throttle valve in response to depression of the vehicle accelerator pedal through a large angle comparable to approximately seventy percent of its total travel, followed by a faster rate of the remaining opening movement of the throttle valve in response to the remaining thirty percent of angular movement of the accelerator pedal to the throttle valve wide open position, the two movements together being accomplished smoothly and efficiently without an appreciable indication to the vehicle operator of a change in the rate of movement.

Other objects, features and advantages of the invention will become more apparent upon reference to the succeeding, detailed description thereof, and to the drawings illustrating the preferred embodiments thereof: wherein.

Figures 1, 2:
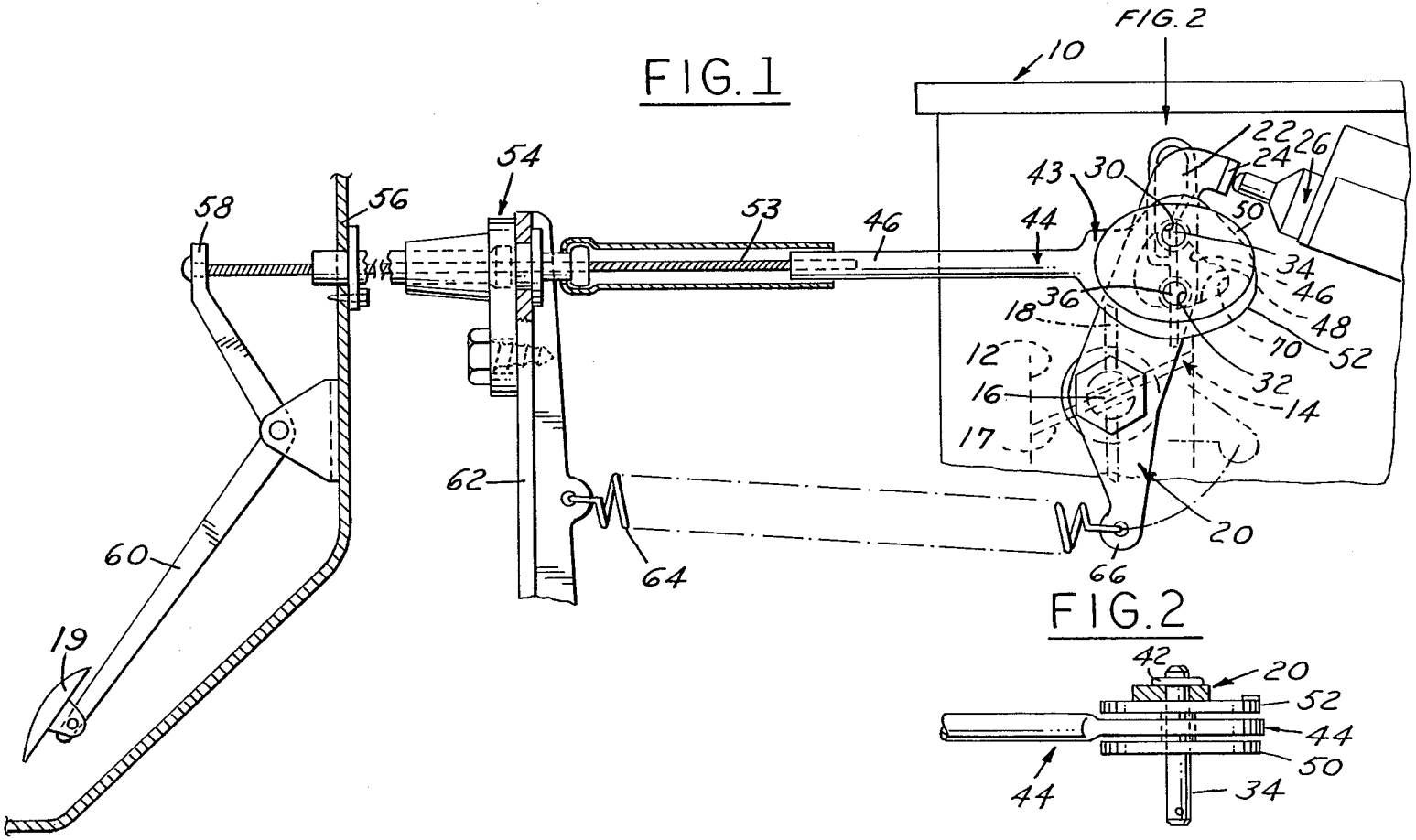
FIG. 1 illustrates schematically a side elevational view, with parts broken away and in section, of a cable mechanism embodying the invention.
FIG. 2 is a top view of a detail of FIG. 1.

FIG. 1 shows an assembly that connects the conventional vehicle accelerator pedal to a throttle body throttle valve in a manner to be described to provide the dual rate movement desired. More particularly, the assembly includes a portion 10 of a conventional throttle body having the usual air/air-fuel induction passage 12. Flow is controlled by a plate type throttle valve 14 that is fixedly mounted on a shaft 16 that is rotatably mounted in the sidewalls of the carburetor. The valve 14 rotates from the an engine idle speed closed throttle position 17 to a wide open throttle position 18. In conventional construction, initial depression of the vehicle accelerator pedal 19 provides a fast corresponding movement of throttle valve 14 through a large opening angle, thus providing a relatively fast forward vehicle acceleration. This also may result in driveline "clunk" due to a reverse application of torque being applied as the drivetrain changes from a coast-down overrunning condition to a drive condition.

One of the main purposes of the invention is to eliminate the unsmooth accelerations and "clunk"/noise conditions by delaying or slowing down the response of the throttle valve to the large initial angular depression of the vehicle accelerator pedal until the throttle valve reaches a predetermined opening, at which point the rate of movement of the throttle valve is increased essentially without an increase in the rate of movement of the vehicle accelerator pedal so that the transition from closed to wide open throttle positions is constant and uniform. This also permits a more accurate control of the opening movement of the throttle valve compared to prior constructions since the initial slow rate of movement of the throttle valve in response to a large travel of the accelerator pedal and corresponding cable linkage provides a finer tuning of the movement of the throttle valve compared to that of the prior art.

Returning now to FIG. 1, fixedly attached to throttle valve shaft 16 is a bellcrank type lever 20. The upper arm or end 22 of the lever is bent and provided with a right angled flange 24 for engagement with the end of a known type of dash pot mechanism 26. The details of construction and operation of the latter are known and therefore not given since they are believed to be unnecessary for an understanding of the invention. Suffice it to say that, in general, the dash pot slows closing of the throttle valve lever 20 to the engine idle speed position when the accelerator pedal is released to prevent stalling of the vehicle by too rapid a cut-off of supply of air to the vehicle.

The upper arm 22 of throttle lever 20 in this case has a pair of holes or apertures 30, 32 (also see FIG. 3) at varying or different radial distances from the pivot shaft 16. Each of the holes is adapted to receive pivotally therein a shaft 34, 36, the shafts having appropriate cotter pin type holes 38, 40 at their ends (FIG. 4) into which is inserted a keeper 42.

Both pins 34 and 36 are adapted to be inserted and project into the hollow interior of the oval shaped cam portion 43 of a cam, cam follower type lever 44 formed at its other end with a rod like actuating end 46. A pair of retaining plates 50, 52 fixedly secured on pins 34, 36 enclose the open sides of the cam. The cam lever assembly thus consists of a rod 46 having a washer like end 43 having in this case an essentially heart-shaped interior cam surface 48 with which a pair of pins 34, 36 engage, and the sides of which are enclosed by a pair of plates 50, 52 affixed to the pins that are pivotally mounted to throttle lever 20. As will be described more clearly later, this construction permits an operation that includes an initial linear movement of rod 46 a large distance with a slow pivotal movement of the throttle lever 20 in response thereto, and a subsequent smaller linear travel of rod 46 providing a faster angular movement of the throttle lever 20.

The rod end 46 of cam lever 44 is secured to one end of a Bowden wire type cable 53, the latter projecting through a fitting 54 and the vehicle firewall 56 for attachment to the upper end 58 of the vehicle accelerator pedal bellcrank lever 60, as shown. The fitting 54 in this case is screwed to a engine bracket 62 to which is attached one end of a throttle valve return spring 64. The opposite end of the spring is secured to the lower crank arm portion 66 of throttle lever 20.

Before proceeding to the operation, it should be clear from the above that the distance from the throttle lever pivot 16 to pin 34 will establish one lever arm of a certain length; while the distance from pivot 16 to the pin 36 will establish a shorter lever arm, thereby providing different rates of movement of throttle lever 20 depending upon which pin is acting as a fulcrum about which the other pin pivots.

In operation, therefore, depression of accelerator pedal 19 will draw cable 53 leftwardly, as seen in FIG. 1, to more rod 46 and cam 43 in the same direction. The geometry, i.e., the contour of cam surface 48, is such that with outer pin 34 attached to throttle lever 20 at the greater radial distance from pivot shaft 16, leftward movement of the whole assembly will swing pin 34 on an arc as shown about pivot 16, by movement of the cam follower surface 48 against pin 34. This will establish pin 34 as a fulcrum about which pin 36 will move in a counterclockwise direction because of its attachment to lever 20 until pin 36 reaches the end point 70 of the essentially heart-shaped cam surface. The reaction then will shift the fulcrum from outer pin 34 to the radially inner pin 36 as evidenced in FIG. 3 by the movement of pin 34. It will be noted that rod 46 will have travelled leftwardly a relatively large distance as compared to the relatively small angular movement of pin 36 before pin 36 is stopped at the point 70. This small slow movement of pin 36, however, will provide an opening movement of the throttle valve of approximately fifty percent of its total opening.

Figure 3:
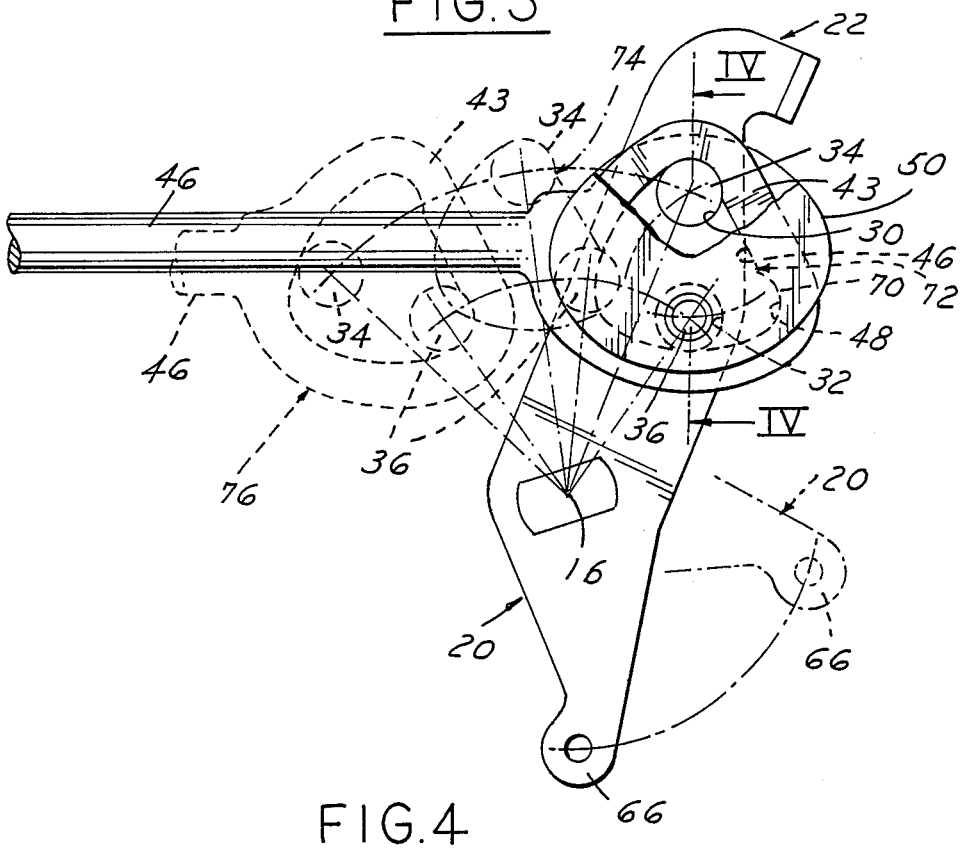
FIG. 3 is an enlarged view of a detail of FIG. 1, with parts broken away and in section.
Figure 4:
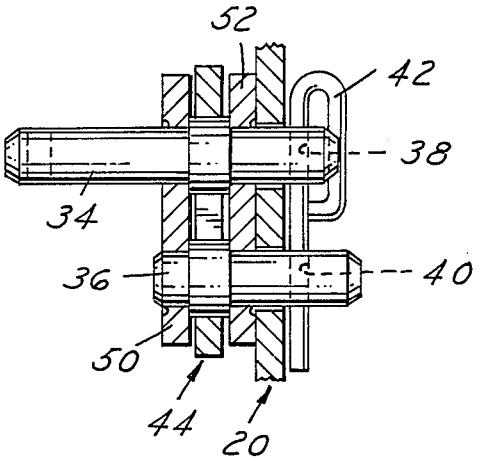
FIG. 4 is a cross-sectional view taken on a plane indicated by and viewed in the direction of the arrows IV—IV of FIG. 3.

The throttle lever now will pivot about the point 16 using the shorter lever arm from the pivot to the pin 36 as the control. Pin 36 now is established as the fulcrum about which the pin 34 will pivot. Continued leftward movement of cam lever 46, therefore, now continues the counterclockwise pivotal movement of throttle lever 20 about its pivot using the shorter arm to determine the travel. The pin 34 now rotates counterclockwise at a faster rate in proportion to the rate of pivotal movement of lever 20. Thus, the throttle valve opens at a faster rate than initially. However, insofar as the vehicle operator is concerned, depression of the vehicle accelerator pedal has been made essentially in a constant, smooth manner from initial opening to its wide open throttle position, since the change in rate of movement of the throttle valve is essentially imperceptible. The three throttle lever positions, i.e., initial 72, changeover 74, and wide open throttle 76, are indicated in FIG. 3 in dotted lines. The differences in linear travel of the rod 46 also will be clear. Of course, release of the vehicle accelerator pedal 19 towards the closed throttle valve position will cause a movement of the parts and operation in reverse; i.e., throttle valve 14 first will move clockwise at a fast rate as pin 34 is forced rightwardly or clockwise to the changeover position 74 shown, followed by a slower pivotal movement of the throttle valve and lever 20 to the initial position 72 as the fulcrum changes from pin 36 to pin 34, shifting the pivoting from the shorter to the longer lever arm.

Figure 5:
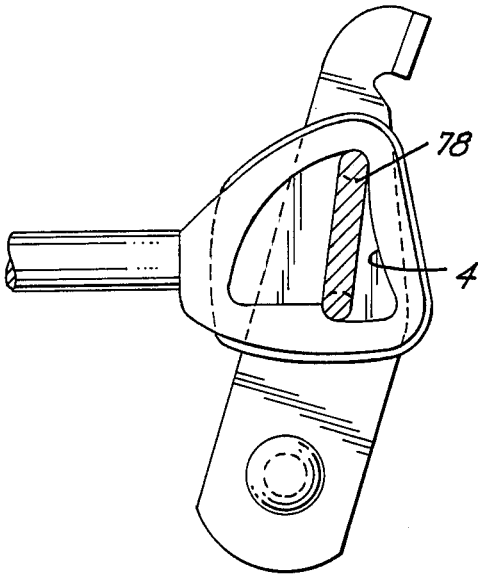
FIGS. 5 and 6 are side elevational views, with parts removed for clarity, of modifications.
Figure 7:
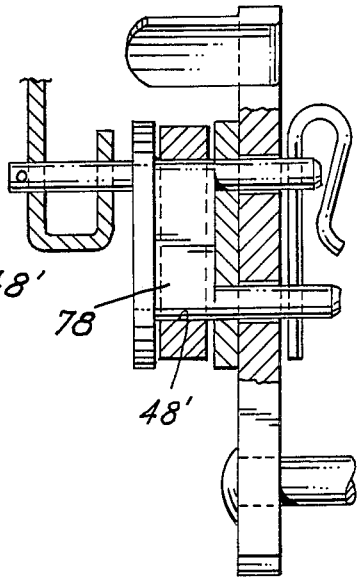
FIG. 7 is an end elevational view of the embodiment shown in FIG. 5.
Figure 6:
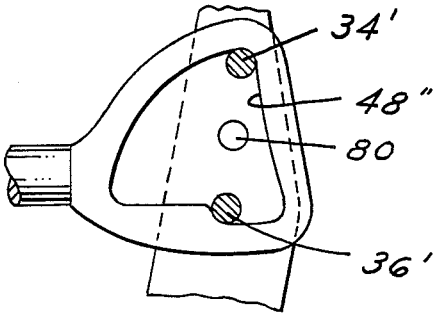

FIGS. 5–7 show modified versions of the cam lever assembly shown and described in FIGS. 1–4. More particularly, FIG. 5 shows the use of a one piece tang 78 instead of two pins engaging cam surface 48'. In this instance, the continuous surface of the tang provides an infinite number of fulcrums or pivot points cooperating with the cam surface 48'. Cam surface 48' would be contoured so as to progressively vary the rate of movement of the throttle lever 20 upon depression of the vehicle accelerator pedal.

FIG. 6 is a showing similar to FIG. 5; however, in this case, instead of a one piece tang 78, an additional pin 80 pivotally secured to throttle lever 20 is placed radially between the two pins 34', 36'. Again, the pin 80 provides an additional fulcrum when it engages the cam surface 48" and about which the other pins can pivot to provide a different rate of movement of throttle lever 20 than those established by engagement of pins 34 and 36 with the cam surface. The cam surface 48", again, would be contoured to provide the desired cooperation with the number of pins provided. It will also be clear that embodiments other than those of FIGS. 5 and 6 could be provided showing more pins than that of FIG. 6, for example, accompanied by an appropriate contouring of the cam surface with which each cooperates.

From the foregoing, therefore, it will be seen that the invention provides an accelerator cable mechanism establishing variable rates of movement of the throttle lever in response to depression of the vehicle accelerator pedal, and a mechanism that is simple in construction and consists of few parts that are easy to assemble and disassemble and is efficient in operation.

While the invention has been shown and described in its preferred embodiments, it will be clear to those skilled in the arts to which it pertains that many changes and modifications may be made thereto without departing from the scope of the invention.

I claim:

1. In combination, in a motor vehicle, a vehicle accelerator pedal, an air/air-fuel throttle body, the throttle body having an air/ air-fuel induction passage and a throttle valve shaft rotatably mounted therein and having a throttle valve fixed thereto, and a throttle lever fixed on the shaft for concurrent movement with the throttle valve, the throttle valve being pivotally movable between positions variably opening and closing the induction passage, and a linear movable variable rate movement accelerator cable assembly connecting the accelerator pedal to the throttle valve, the cable assembly including a cable connected at one end to the accelerator pedal and a cam fixed to the opposite end, and cam follower means fixed on the throttle lever at a point radially spaced from the shaft , the cam having an essentially heartshaped cam slot defining an internal cam surface, the cam follower means consisting of a plurality of parts projecting laterally from the throttle lever into the slot and each being engaged at times by the cam surface, the plurality of parts being radially spaced from one another whereby continued linear movement of the cable assembly at essentially a constant rate by pivoting of the vehicle accelerator pedal from an initial at-rest engine idle speed position initially effects an arcuate pivotal movement of the throttle lever and throttle valve at a first rate of movement by the engagement of and the forced arcuate pivotal movement of one of the cam follower means parts by the cam surface about another one of the plurality of cam follower means parts as a fulcrum followed by an arcuate pivotal movement of the throttle lever and throttle valve at a second different rate of movement by the engagement of and the forced arcuate pivotal movement of the another of the plurality of cam follower means parts by the cam surface about the one cam follower means parts as a fulcrum.

2. A mechanism as in claim 1, wherein the cam follower parts comprise a plurality of pins pivotally secured to the throttle lever at different radial extents from the lever pivot.

3. A mechanism as in claim 1, wherein the cam follower parts comprise at least three radially spaced pins extending at right angles from the throttle lever into the hollow interior of the cam for engagement with the cam surface therein.

* * * * *